US012703063B2

(12) United States Patent
Miyamoto

(10) Patent No.: US 12,703,063 B2
(45) Date of Patent: Aug. 11, 2026

(54) SUBSTRATE PROCESSING APPARATUS

(71) Applicant: EBARA CORPORATION, Tokyo (JP)

(72) Inventor: Matsutaro Miyamoto, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 362 days.

(21) Appl. No.: 18/461,520

(22) Filed: Sep. 6, 2023

(65) Prior Publication Data

US 2024/0139909 A1 May 2, 2024

(30) Foreign Application Priority Data

Oct. 28, 2022 (JP) ..... 2022-173093

(51) Int. Cl.
*B24B 53/017* (2012.01)
*B24B 37/04* (2012.01)

(52) U.S. Cl.
CPC ..... *B24B 53/017* (2013.01); *B24B 37/04* (2013.01)

(58) Field of Classification Search
CPC ..... B24B 41/04; B24B 41/047; B24B 41/053; B24B 47/10; B24B 53/017; B24B 53/12; B24B 55/04; B24B 7/04; B24B 7/228; B24B 37/04; B24B 37/105; B23Q 11/08
USPC ..... 451/46, 443, 290, 292, 362
See application file for complete search history.

(56) References Cited

U.S. PATENT DOCUMENTS 6,315,651 B1 * 11/2001 Kuo ..... B24B 55/04 451/451
2017/0008144 A1 * 1/2017 Shinkai ..... B24B 53/017
2020/0402820 A1 * 12/2020 Kitagawa ..... B24B 37/10

FOREIGN PATENT DOCUMENTS

| | | |
|---|---|---|
| JP | 2014111301 | 6/2014 |
| JP | 6580178 | 9/2019 |
| JP | 2019209410 | 12/2019 |
| JP | 2021002612 | 1/2021 |

* cited by examiner

*Primary Examiner* — Robert F Neibaur
(74) *Attorney, Agent, or Firm* — JCIPRNET

(57) ABSTRACT

The substrate processing apparatus according to the disclosure is a substrate processing apparatus for processing a substrate. The substrate processing apparatus includes a swing module, which includes a base portion, an arm which is supported by the base portion and is rotatable about the base portion, and a cover which covers an upper surface of the arm. The cover has an elongated shape in plan view and has a protrusion formed on an outer peripheral portion of an upper surface of the cover to protrude upward. The protrusion is provided to be continuous to a distal end which is an end on the side farther from the base portion of the upper surface of the cover in a longitudinal direction and both ends of the upper surface of the cover in a transverse direction.

8 Claims, 7 Drawing Sheets

SUBSTRATE PROCESSING APPARATUS

CROSS-REFERENCE TO RELATED APPLICATION

This application claims the priority benefits of Japanese application no. 2022-173093, filed on Oct. 28, 2022. The entirety of the above-mentioned patent application is hereby incorporated by reference herein and made a part of this specification.

BACKGROUND

Technical Field

The disclosure relates to a substrate processing apparatus.

Description of Related Art

A polishing device is used in a semiconductor manufacturing process to polish a surface of a substrate. The polishing device uses slurry (polishing liquid) to polish the substrate. When polishing the substrate, slurry scatters and adheres to a cover for a component of the polishing device. Then, the slurry adhering to the cover is solidified when the slurry is dried. When the solidified slurry falls off the cover and contacts the surface of the substrate during polishing, problems such as scratches may occur on the substrate. Therefore, there is a demand for a polishing device having a configuration that can prevent such problems from occurring.

For example, Patent Document 1 (Japanese Patent No. 6580178) discloses a cover for a component of a polishing device. In the cover of the component of the polishing device of Patent Document 1, as illustrated in FIG. 2, an outer surface of the cover exposed to the outside does not have a recess and does not have a horizontal surface except for the top of the cover. Since the cover of Patent Document 1 has such a configuration, a polishing liquid does not stay in the recess of the cover. Further, since the cover does not have a horizontal plane except for the top of the cover, scattered polishing liquid does not accumulate easily. Thus, the polishing liquid is less likely to adhere to the cover. As a result, solidified matter is less likely to be formed from the polishing liquid adhering to the cover and the substrate is less likely to be scratched by the solidified matter.

Further, a polishing device disclosed in Patent Document 2 (Japanese Patent Laid-Open No. 2014-111301) is accommodated in a chamber as illustrated in FIG. 2. A plurality of spray nozzles for spraying a cleaning liquid is arranged inside the chamber. These spray nozzles spray a cleaning liquid onto a wall surface of the chamber or the cover of the component of the polishing device to keep the wall surface of the chamber or the cover of the component of the polishing device wet. As a result, the polishing liquid is prevented from drying by adhering to the wall surface of the chamber or the cover of the component of the polishing device. Then, the dried and solidified polishing liquid is prevented from falling onto the substrate and the substrate is prevented from being scratched by the solidified matter of the polishing liquid.

Further, as illustrated in FIG. 5, a first polishing unit (polishing device) disclosed in Patent Document 3 (Japanese Patent Laid-Open No. 2019-209410) includes a spray nozzle for spraying a cleaning liquid to each part constituting the first polishing unit. In the first polishing unit, each part constituting the first polishing unit is cleaned by the cleaning liquid and slurry adhering to each part is washed away before the slurry is solidified. That is, the occurrence of scratches on the substrate due to solidified matter of the polishing liquid is suppressed.

As described above, in the polishing device disclosed in Patent Document 2 or 3, the cleaning liquid is supplied to the component of the polishing device. Therefore, a processing liquid such as a cleaning liquid may be accumulated on the upper surface of the cover of swing components such as a top ring, a polishing liquid supply nozzle, a dresser, and an atomizer which are components of the polishing device. Then, the processing liquid may fall from the cover of the swing component and adhere to the substrate. In order to solve such problems, Patent Document 4 (Japanese Patent Laid-Open No. 2021-2612) discloses a cover for a swing component capable of preventing a processing liquid from being accumulated on an upper surface of the cover.

In the cover disclosed in Patent Document 4, as illustrated in FIG. 3, the upper surface of the cover is inclined downward over the entire length of the cover from the distal end to the base end in the longitudinal direction of the cover. Accordingly, this cover allows the processing liquid adhering to the upper surface of the cover to flow downward to the base end of the cover.

As described above, in the cover for the swing component of the substrate processing apparatus disclosed in Patent Document 4, the inclination of the upper surface of the cover causes the processing liquid to flow toward the base end and remove the processing liquid from the upper surface. However, the processing liquid may not be completely removed from the upper surface of the cover and a part of the processing liquid may remain on the upper surface of the cover. Such a remaining processing liquid receives a centrifugal force due to the swinging motion of the swing component about the base end, moves toward the distal end far from the rotation center of the cover, and fall downward from the outside of the distal end of the cover. In such a case, the processing liquid may be dripped or scatted from the cover and adhere to the peripheral members.

Here, the disclosure provides a substrate processing apparatus capable of suppressing a liquid remaining on an upper surface of a cover from falling downward from the outside of a distal end of the cover when an arm of a swing module (swing component) swings.

SUMMARY

A substrate processing apparatus according to an embodiment is a substrate processing apparatus for processing a substrate. The substrate processing apparatus includes a swing module. The swing module includes a base portion, an arm which is supported by the base portion and is rotatable about the base portion, and a cover which covers an upper surface of the arm. The cover has an elongated shape in plan view and has a protrusion formed on an outer peripheral portion of an upper surface of the cover to protrude upward, and the protrusion is provided to be continuous to a distal end which is an end on the side farther from the base portion of the upper surface of the cover in a longitudinal direction and both ends of the upper surface of the cover in a transverse direction.

DESCRIPTION OF THE EMBODIMENTS

Figure 1:
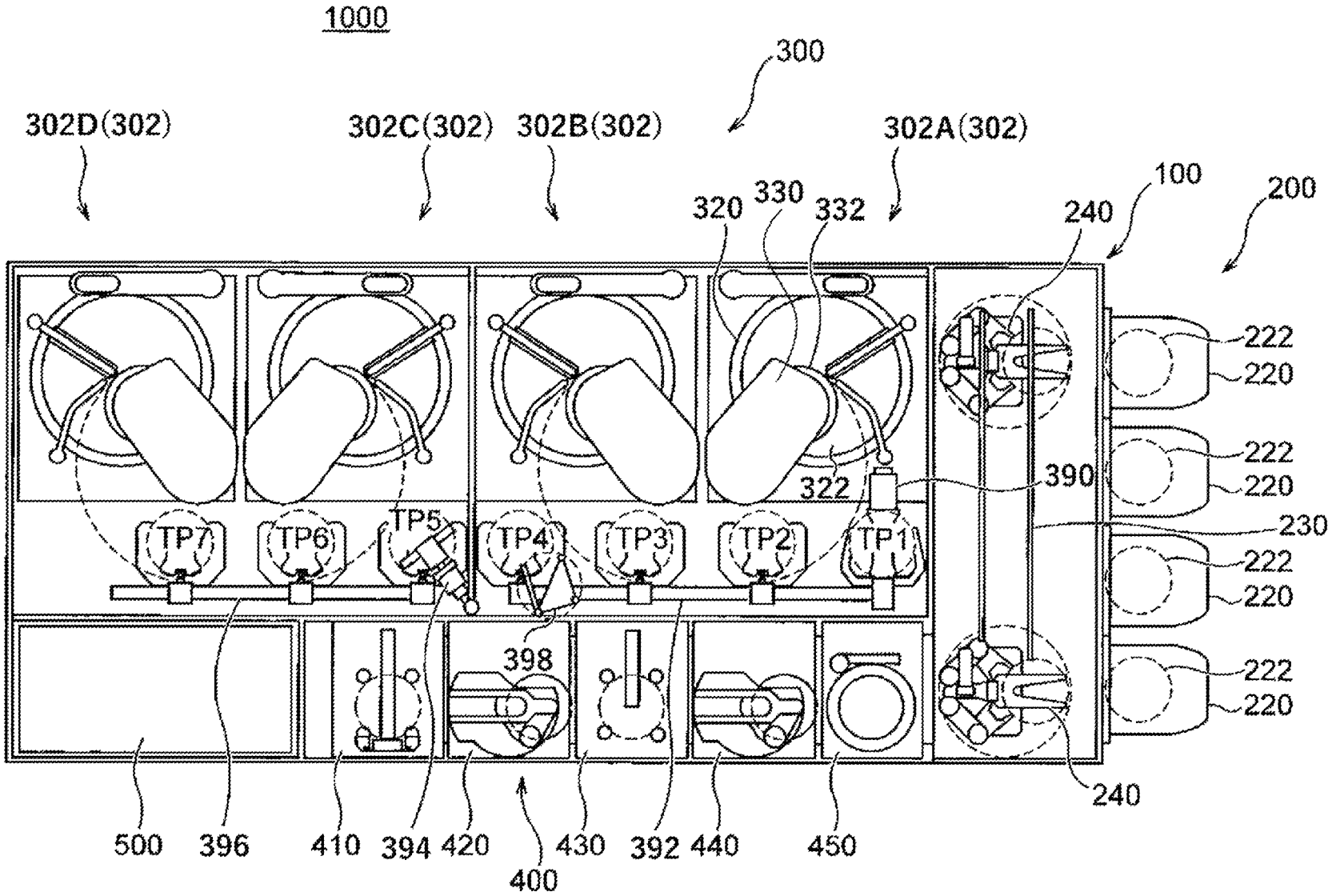
FIG. 1 is a plan view illustrating an overall configuration of a substrate processing apparatus of this embodiment.

Hereinafter, an embodiment of the present disclosure will be described with reference to the drawings. In the drawings described below, the same or corresponding components are denoted by the same reference numerals, and redundant descriptions are omitted.

<Substrate Processing Apparatus 1000>

FIG. 1 is a plan view illustrating an overall configuration of a substrate processing apparatus 1000 of this embodiment. The substrate processing apparatus 1000 is an apparatus for processing a semiconductor substrate W. Additionally, the semiconductor substrate W includes wafers such as silicon wafers, glass wafers, and quartz wafers. Referring to FIG. 1, the substrate processing apparatus 1000 includes a load/unload module 200, a polishing module 300, and a cleaning module 400. Further, the substrate processing apparatus 1000 includes a control module 500 for controlling various operations of the load/unload module 200, the polishing module 300, and the cleaning module 400. Hereinafter, the configuration of each part of the substrate processing apparatus 1000 will be described.

<Load/Unload Module 200>

The load/unload module 200 transfers the substrate W before being subjected to processing such as polishing and cleaning to the polishing module 300 and receives the substrate W after being subjected to processing such as polishing and cleaning from the cleaning module 400. The load/unload module 200 includes a plurality of (four in this embodiment) front load unit 220. A cassette 222 for stocking the substrates W is mounted on each of the front load units 220.

The load/unload module 200 includes a rail 230 which is installed inside a housing 100 and a plurality of (two in this embodiment) transport robots 240 which is arranged on the rail 230. The transport robot 240 takes out the substrate W before being subjected to processing such as polishing and cleaning from the cassette 222 and transfers the substrate to the polishing module 300. Further, the transport robot 240 receives the substrate W subjected to processing such as polishing and cleaning from the cleaning module 400 and returns the substrate to the cassette 222.

<Polishing Module 300>

The polishing module 300 has a function of polishing the substrate W. The polishing module 300 includes a first polishing device (CMP device: Chemical Mechanical Polishing device) 302A, a second polishing device (CMP device) 302B, a third polishing device (CMP device) 302C, and a fourth polishing device (CMP device) 302D. Each of the first polishing device 302A, the second polishing device 302B, the third polishing device 302C, and the fourth polishing device 302D has a function of polishing the substrate W using a polishing liquid. Further, the first polishing device 302A, the second polishing device 302B, the third polishing device 302C, and the fourth polishing device 302D have the same configuration as an example. Therefore, in the disclosure, the first polishing device 302A, the second polishing device 302B, the third polishing device 302C, and the fourth polishing device 302D may be simply referred to as the polishing device 302.

Referring to FIG. 1, the first polishing device 302A includes a polishing table 320 and a top ring device 330 having a top ring 332. The polishing table 320 is rotationally driven by a drive unit 328 (see FIG. 2). A polishing pad 322 is attached to the polishing table 320. The top ring 332 holds the substrate W and presses the substrate against the polishing pad 322. The top ring 332 is rotationally driven by a drive source (not illustrated). The substrate W is polished by being held by the top ring 332 and pressed against the polishing pad 322.

Next, a transport mechanism for transporting the substrate W will be described. The transport mechanism includes a lifter 390, a first linear transporter 392, a swing transporter 394, a second linear transporter 396, and a temporary placement table 398.

The lifter 390 receives the substrate W from the transport robot 240. The first linear transporter 392 transports the substrate W received from the lifter 390 between a first transport position TP1, a second transport position TP2, a third transport position TP3, and a fourth transport position TP4. The first polishing device 302A and the second polishing device 302B receive the substrate W from the first linear transporter 392 and polish the substrate. The first polishing device 302A and the second polishing device 302B transfer the polished substrate W to the first linear transporter 392.

The swing transporter 394 transfers the substrate W between the first linear transporter 392 and the second linear transporter 396. The second linear transporter 396 transports the substrate W received from the swing transporter 394 between a fifth transport position TP5, a sixth transport position TP6, and a seventh transport position TP7. The third polishing device 302C and the fourth polishing device 302D receive the substrate W from the second linear transporter 396 and polish the substrate. The third polishing device 302C and the fourth polishing device 302D transfer the polished substrate W to the second linear transporter 396. The substrate W polished by the polishing module 300 is placed on the temporary placement table 398 by the swing transporter 394.

<Cleaning Module 400>

The cleaning module 400 has a function of cleaning and drying the substrate W polished by the polishing module 300. The cleaning module 400 includes a first cleaning chamber 410, a first transport chamber 420, a second cleaning chamber 430, a second transport chamber 440, and a drying chamber 450.

The substrate W placed on the temporary placement table 398 is transported to the first cleaning chamber 410 or the second cleaning chamber 430 through the first transport chamber 420. The substrate W is cleaned in the first cleaning chamber 410 or the second cleaning chamber 430. The substrate W cleaned in the first cleaning chamber 410 or the second cleaning chamber 430 is transported to the drying chamber 450 through the second transport chamber 440. The substrate W is dried in the drying chamber 450. The dried substrate W is taken out from the drying chamber 450 by the transport robot 240 and is returned to the cassette 222.

<Polishing Device 302>

Figure 2:
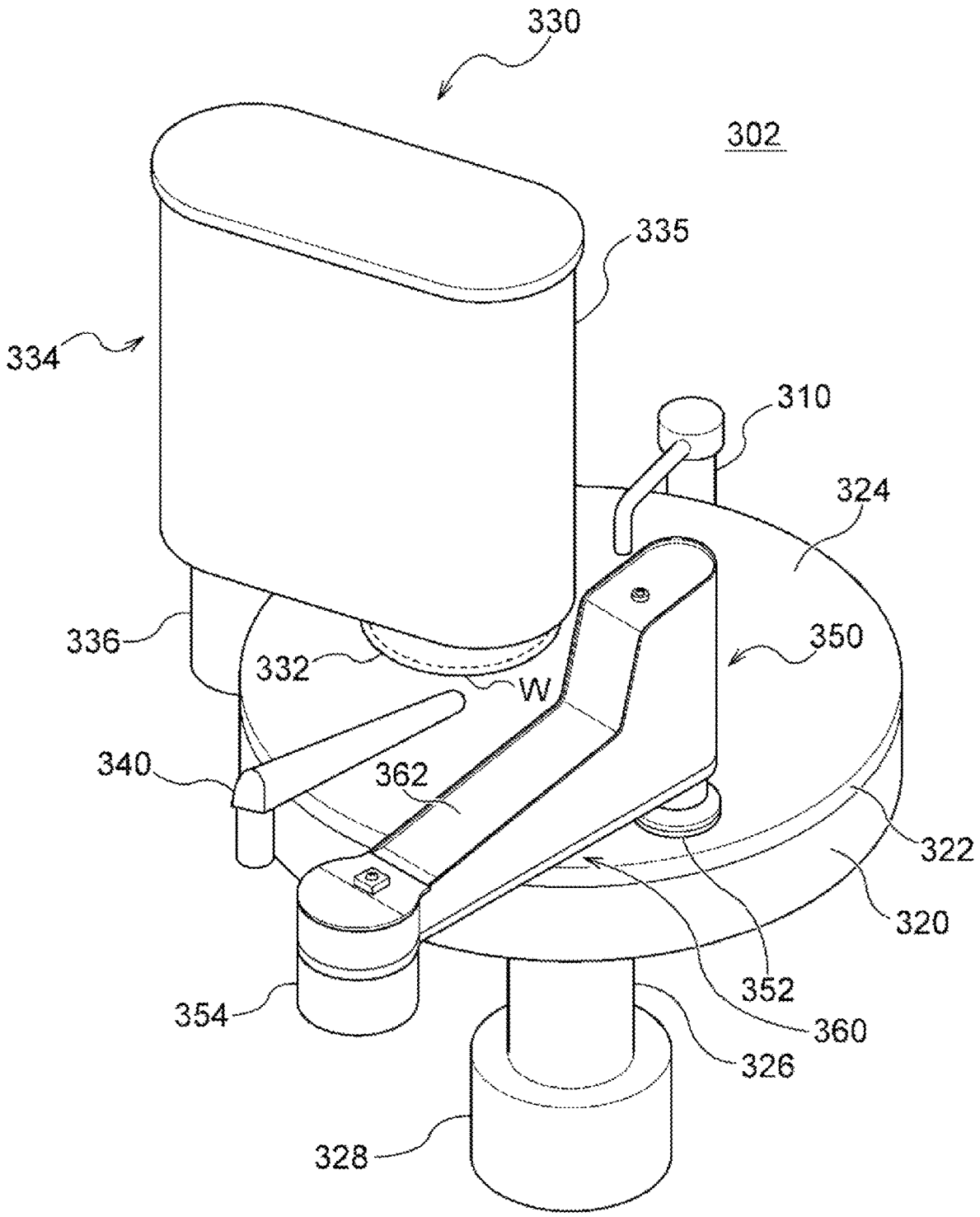
FIG. 2 is a perspective view schematically illustrating a polishing device illustrated in FIG. 1.
Figure 3:
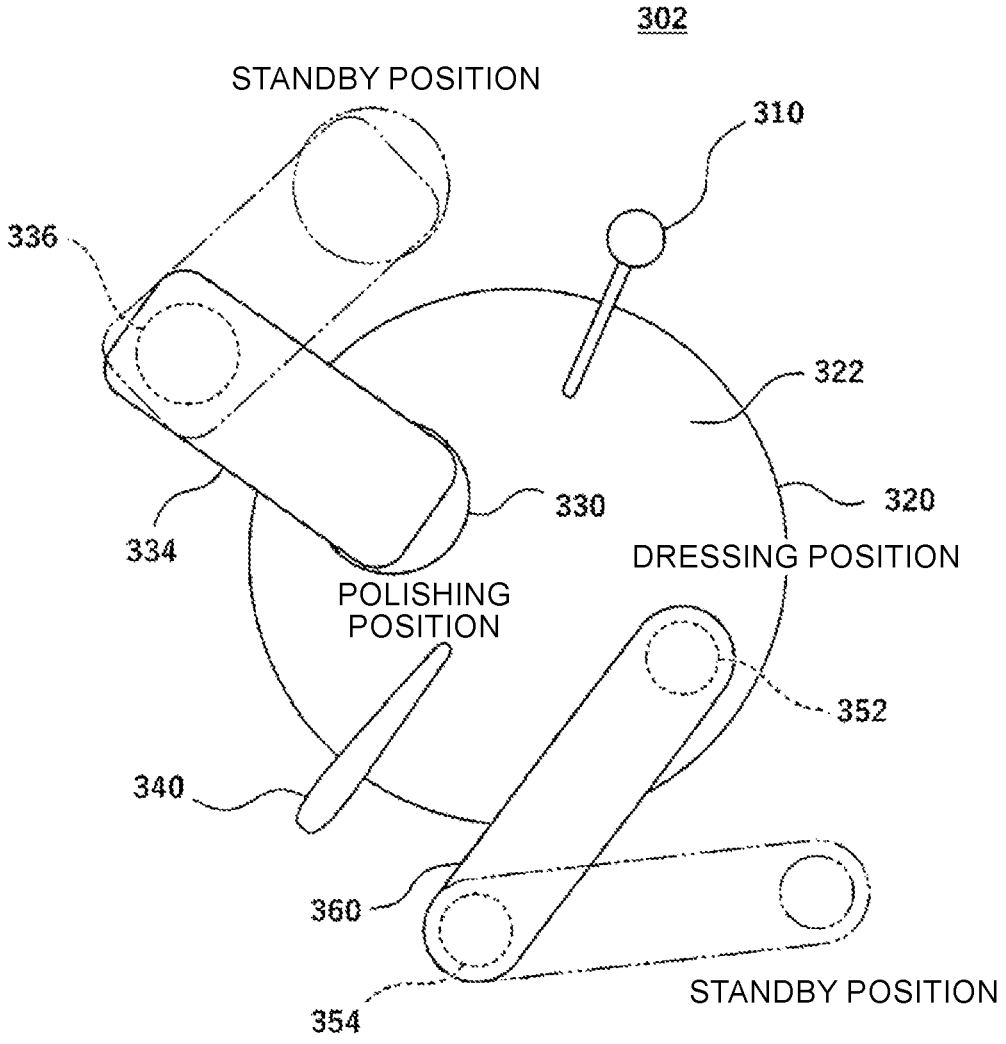
FIG. 3 is a plan view schematically illustrating the polishing device illustrated in FIG. 1.

Next, FIGS. 2 and 3 are referred. FIG. 2 is a perspective view schematically illustrating the polishing device 302. FIG. 3 is a plan view schematically illustrating the polishing device 302. Referring to FIGS. 2 and 3, the polishing device 302 includes the polishing table 320, a polishing liquid supply nozzle 310, an atomizer 340, and the top ring device 330 as an example.

The polishing table 320 supports a polishing pad 322 having a polishing surface 324. The polishing table 320 is supported by a table shaft 326. The polishing table 320 is configured to rotate around the axis of the table shaft 326 by the drive unit 328.

The polishing liquid supply nozzle 310 is configured to supply a polishing liquid or dressing liquid to the polishing pad 322. The polishing liquid is slurry as an example. The dressing liquid is pure water as an example. During polishing, the polishing liquid is supplied from the polishing liquid supply nozzle 310 to the polishing surface 324 of the polishing pad 322. On the other hand, the dressing liquid is supplied from the polishing liquid supply nozzle 310 to the polishing surface 324 of the polishing pad 322 during dressing.

The atomizer 340 has a function of injecting a cleaning fluid toward the polishing pad 322 to clean the polishing pad 322. The atomizer 340 extends along the radial direction of the polishing pad 322 (or the polishing table 320). The cleaning fluid is composed of a mixed fluid of a cleaning liquid (pure water as an example) and a gas (an inert gas such as nitrogen gas as an example) or only the cleaning liquid. The atomizer 340 injects the cleaning fluid onto the polishing surface 324 to remove polishing dust remaining on the polishing surface 324 of the polishing pad 322 and abrasive grains contained in the polishing liquid.

The top ring device 330 includes the top ring 332, a top ring head 334, and a swing shaft 336. The top ring head 334 includes a top ring cover 335 which covers the entire top ring head 334. Then, the top ring cover 335 has a shape of covering the upper portion of the top ring 332. Accordingly, it is possible to prevent the polishing liquid from entering the upper portion of the top ring 332 and the polishing liquid from entering the inside of the top ring head 334. Further, the top ring head 334 includes a top ring shaft (not illustrated) to which the top ring 332 is fixed, a top ring rotating device (not illustrated) which rotates the top ring 332 through the top ring shaft, and a top ring elevating device (not illustrated) which elevates the top ring 332. Additionally, in the top ring device 330, a part of the top ring shaft, the top ring rotating device, and the top ring elevating device are covered with the top ring cover 335.

Further, the top ring 332 is configured to hold the substrate W on the surface facing the polishing surface 324 in the top ring 332 by vacuum suction. Further, the top ring head 334 is supported by the swing shaft 336 and is rotatable about the swing shaft 336. Accordingly, the top ring head 334 can move between a polishing position above the polishing table 320 and a standby position outside the area directly above the polishing table 320 (see FIG. 3).

The substrate W is polished as follows. The top ring 332 holding the substrate W is moved from the standby position to the polishing position. Each of the top ring 332 and the polishing table 320 rotates in the same direction and the polishing liquid is supplied from the polishing liquid supply nozzle 310 onto the polishing pad 322. In this state, the top ring 332 presses the substrate W against the polishing surface 324 of the polishing pad 322 so that the substrate W is brought into contact with the polishing surface 324. The surface of the substrate W is polished by the chemical action of the polishing liquid and the mechanical action of the abrasive grains contained in the polishing liquid.

As an example, the polishing device 302 includes a spray nozzle (not illustrated) which supplies a cleaning liquid to each component of the polishing device 302 and washes away the polishing liquid adhering to each component. Accordingly, each component of the polishing device 302 is cleaned as necessary. As a result, the polishing liquid adhering to each component of the polishing device 302 is washed away during polishing of the substrate.

Referring to FIG. 2, the polishing device 302 further includes a dressing device (an example of a swing module) 350 as an example. The dressing device 350 has a function of dressing or conditioning the polishing surface 324 of the polishing pad 322. The dressing device 350 includes a dresser 352, a base portion 354, a dresser arm (an example of an arm) 360, and a cover 362. The cover 362 covers the upper portion of the dresser arm 360. Accordingly, it is possible to prevent the polishing liquid from entering the dresser arm 360. Further, the dresser arm 360 supports the dresser 352. More specifically, the dresser arm 360 includes a dresser shaft (not illustrated) to which the dresser 352 is fixed, a dresser rotating device (not illustrated) which rotates the dresser 352 through the dresser shaft, and a dresser elevating device (not illustrated) which elevates the dresser 352. Additionally, in the dressing device 350, a part of the dresser shaft, the dresser rotating device, and the dresser elevating device are covered with the cover 362.

A dressing surface for dressing the polishing surface 324 is formed on the lower surface of the dresser 352. Abrasive grains such as diamond grains are fixed on the dressing surface. During dressing, the dresser 352 contacts the polishing pad 322 to dress the polishing surface 324 of the polishing pad 322.

The base portion 354 has a cylindrical shape and extends vertically. The base portion 354 is fixed to the outside of the polishing table 320 and supports one end of the dresser arm 360.

The dresser arm 360 is supported by the base portion 354 and extends horizontally from the upper portion of the base portion 354. The dresser arm 360 is configured to be rotatable about the base portion 354. When the dresser arm 360 rotates, the dresser 352 swings on the polishing surface 324 in the radial direction of the polishing table 320. The dresser 352 rotates while swinging on the polishing surface 324 of the polishing pad 322 and slightly scrapes the polishing pad 322 to dress the polishing surface 324. Further, the dresser arm 360 can move between a dressing position above the polishing table 320 and a standby position outside the polishing table 320 by rotating about the base portion 354 (see FIG. 3).

Figure 4:
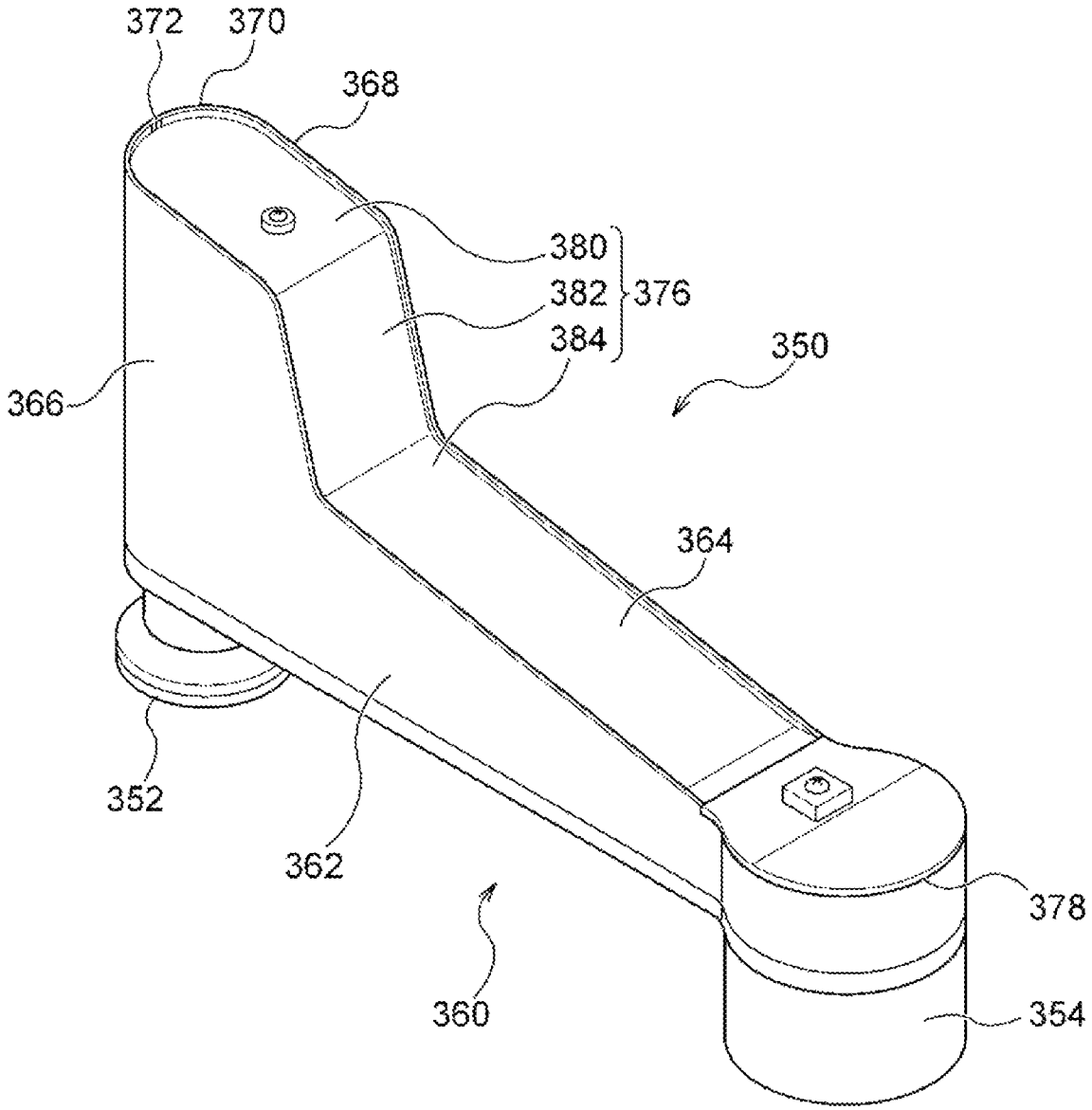
FIG. 4 is a perspective view illustrating a dressing device illustrated in FIG. 2.
Figure 5:
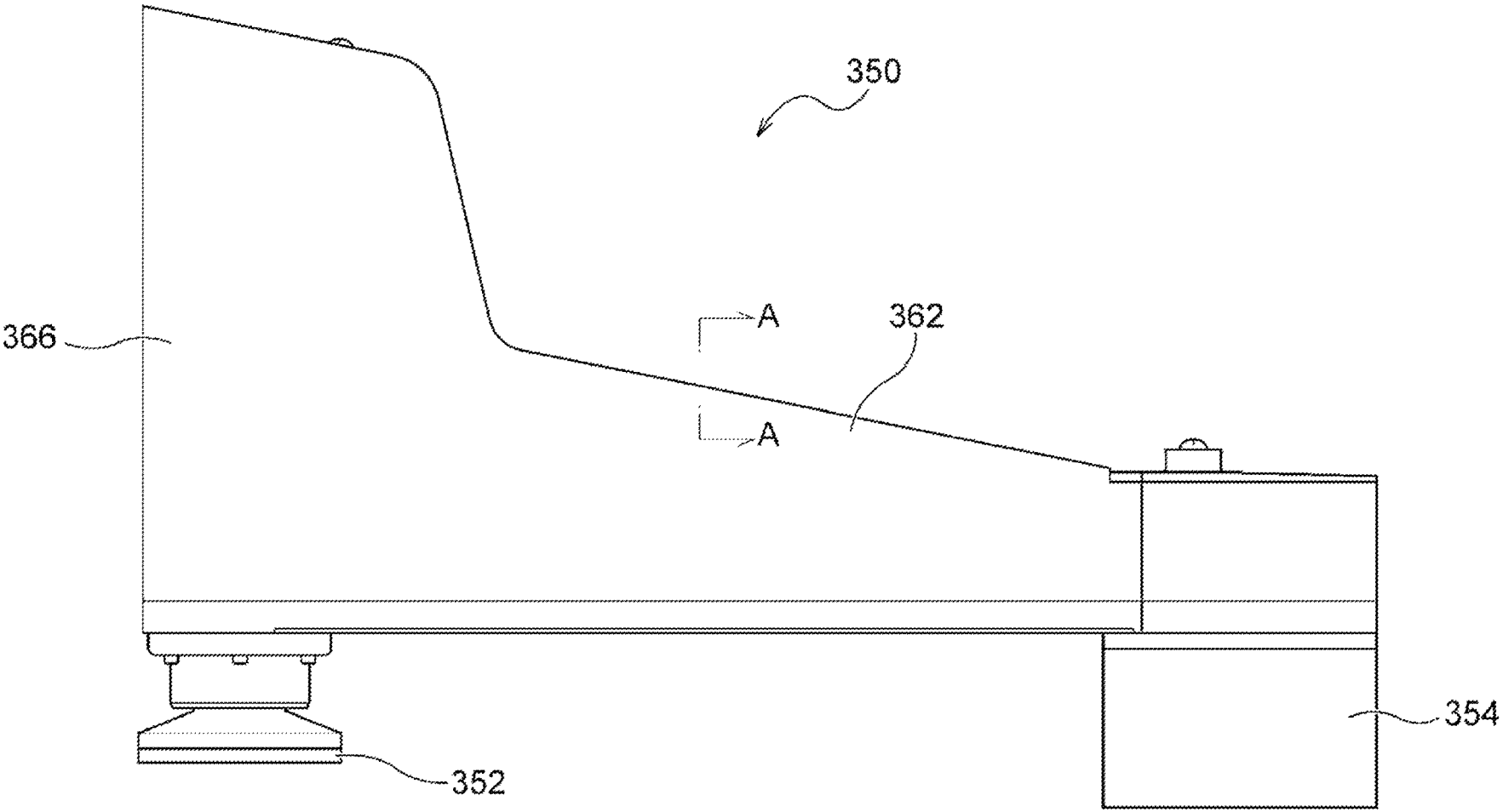
FIG. 5 is a side view of the dressing device of FIG. 4.
Figure 6:
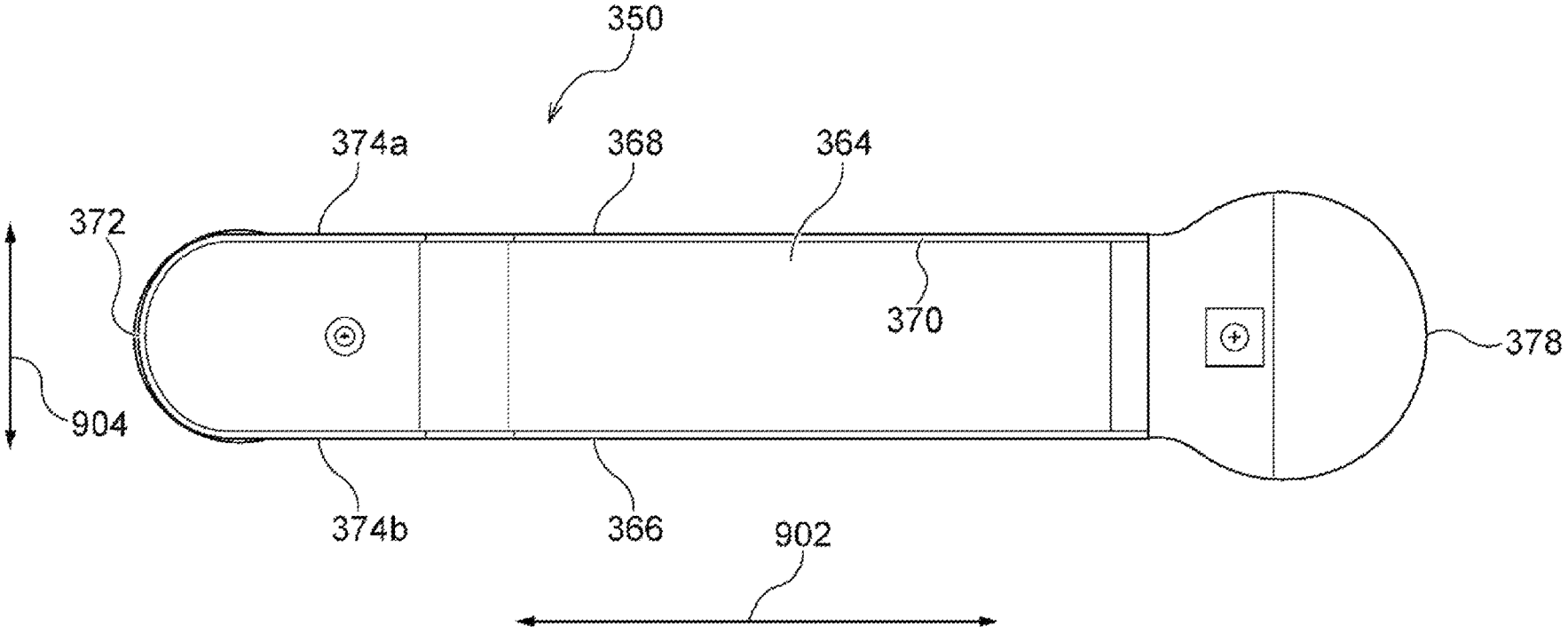
FIG. 6 is a plan view of the dressing device of FIG. 4.
Figure 7:
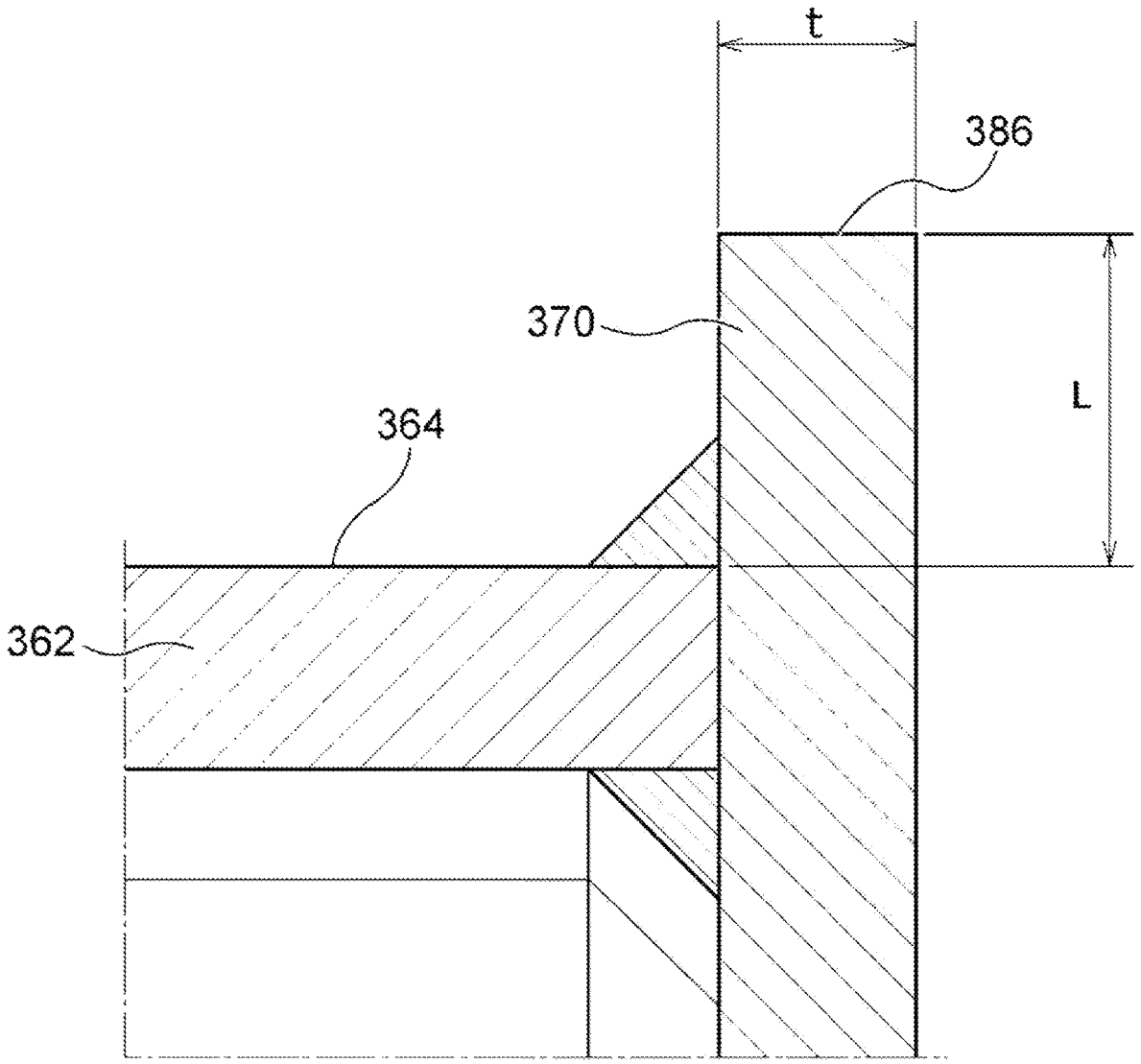
FIG. 7 is a cross-sectional view taken along a line A-A of FIG. 5.

FIG. 4 is a perspective view illustrating the dressing device 350. FIG. 5 is a side view of the dressing device 350. FIG. 6 is a plan view of the dressing device 350. FIG. 7 is a cross-sectional view taken along a line A-A of FIG. 5. Referring to FIGS. 4 to 7, the dressing device 350 will be described in more detail.

Referring to FIG. 4, the cover 362 has an upper surface 364 and a side surface 366 and has an elongated shape in plan view (particularly see FIG. 6). The side surface 366 extends downward from an outer peripheral portion 368 of the upper surface 364. Further, the cover 362 includes a protrusion 370 which protrudes upward on the outer peripheral portion 368 of the upper surface 364. The protrusion 370 is provided to be continuous to a distal end 372 which is an end on the side farther from the base portion 354 of the upper surface 364 of the cover 362 in the longitudinal direction 902 (see FIG. 6) and both ends (a first end 374*a* and a second end 374*b*) of the upper surface 364 of the cover 362 in the transverse direction 904. The height L of the protrusion 370 is 3 mm or more as an example (see FIG. 7). Additionally, in FIG. 7, although the upper end 386 of the protrusion 370 is not chamfered in the cover 362, the upper end may be chamfered outward or inward. In other words, the upper end 386 of the protrusion 370 may be inclined outward or inward. The width t of the protrusion 370 is 3 mm or less as an example.

As described above, each component of the polishing device 302 is cleaned as necessary. When cleaning is performed, the dressing device 350 which is one component of the polishing device 302 is also cleaned. As a result, the liquid used for cleaning may remain on the upper surface 364 of the cover 362 of the dressing device 350. There is a risk that such a remaining liquid receives a centrifugal force due to the swinging motion of the dresser arm 360 about the base portion 354, moves toward the distal end 372 far from the rotation center of the cover 362, and falls downward from the outside of the distal end 372 of the cover 362. Further, the liquid falling from the distal end 372 may mix with the polishing liquid supplied to the polishing surface 324 (see FIG. 2) of the polishing pad 322 and dilute the polishing liquid.

However, such problems are less likely to occur in the dressing device 350. As described above, the cover 362 includes a protrusion 370 which is provided to be continuous to the distal end 372 in the longitudinal direction 902 and both ends 374*a* and 374*b* in the transverse direction 904. Therefore, the protrusion 370 stops the flow of the liquid moving to the distal end 372 due to the rotation of the dresser arm 360 and suppresses the liquid from falling downward from the outside of the distal end 372. Further, since the liquid is suppressed from falling from the distal end 372, the polishing liquid supplied to the polishing surface 324 is also suppressed from being diluted. Since the protrusions 370 are also provided at both ends 374*a* and 374*b* of the transverse direction 904, it is also possible to prevent water droplets from moving in the transverse direction 904 and dripping outside the dresser arm 360 due to an inertial force when the dresser arm 360 swings.

Further, even when the solidified polishing liquid is included in the liquid remaining on the upper surface 364 of the cover 362, this liquid is suppressed from falling from the distal end 372 of the cover 362 onto the polishing surface 324 and hence the solidified polishing liquid is less likely to fall onto the polishing surface 324. As a result, the substrate W is less likely to be scratched due to the contact of the solidified polishing liquid with the substrate W.

Further, in the cover 362, the protrusion 370 is provided on the entire portion that passes directly above the polishing table 320 due to the rotation of the dresser arm 360 in the outer peripheral portion 368 of the upper surface 364 of the cover 362. The liquid on the upper surface 364 of the cover 362 is less likely to fall downward from a portion outside the installation position of the protrusion 370 in the outer peripheral portion 368 of the upper surface 364 of the cover 362. Therefore, in the cover 362, the liquid on the upper surface 364 of the cover 362 is less likely to fall onto the polishing table 320.

Additionally, in the cover 362, the protrusion 370 is not provided on at least a part of the portion that does not pass directly above the polishing table 320 due to the rotation of the dresser arm 360 in the outer peripheral portion 368 of the upper surface 364 of the cover 362. In other words, the protrusion 370 is not provided around a proximal end 378. Accordingly, the liquid adhering to the upper surface 364 of the cover 362 is drained at the position where the protrusion 370 is not provided on the side of the base portion 354 and is not drained to flow toward the polishing table 320.

Further, as illustrated in FIG. 4, the upper surface 364 of the cover 362 has an inclined surface 376 which is inclined downward and toward the base portion 354. The inclined surface 376 extends continuously in the longitudinal direction 902 of the cover 362 from the distal end 372 to the proximal end 378 which is the end near the base portion 354 in the longitudinal direction 902 without being horizontal. Accordingly, in the cover 362, the liquid adhering to the upper surface 364 of the cover 362 flows toward the base portion 354 by the inclined surface 376 and is drained at the position on the side of the base portion 354. Additionally, in the cover 362, the inclined surface 376 includes a first inclined surface 380, a second inclined surface 382, and a third inclined surface 384 which extend linearly. In this way, the inclined surface 376 may be formed by a plurality of linearly extending inclined surfaces. Further, the inclined surface 376 may be configured such that the inclination angle changes in the middle of the inclination.

In the cover 362, the inclined surface 376 may be inclined to the extent that the liquid can flow sufficiently at all positions, but is preferably inclined with respect to, for example, a horizontal plane by 10° or more, 15° or more, 20° or more, or 30° or more. This is because the inclined surface 376 having such an inclination angle allows the liquid to flow sufficiently through the inclined surface 376.

Further, in the cover 362, the side surface 366 extends vertically. In other words, the side surface 366 is inclined with respect to a horizontal plane by 85° or more. Accordingly, the liquid adhering to the side surface 366 tends to flow downward and is less likely to remain on the side surface 366.

Further, a water-repellent layer or hydrophilic layer is formed on the surface of the cover 362. Accordingly, the liquid adhering to the surface of the cover 362 quickly flows to be removed. Additionally, the cover 362 may be coated with a fluorine-based or ceramic-based coating agent to form a water-repellent layer on the surface. Also, the cover 362 may have a hydrophilic layer formed by blasting glass beads on the surface.

Further, the cover 362 is described as a cover for the dressing device 350, but is not limited to this configuration. The cover according to the disclosure can be applied to all swing modules of the substrate processing apparatus 1000. For example, the cover according to the disclosure may be applied to the polishing liquid supply nozzle 310, the atomizer 340, or the top ring device 330 of the polishing device 302. Further, the cover may be applied to the swing module for cleaning the substrate W of the cleaning module 400 of the substrate processing apparatus 1000.

APPENDIX

Some or all of the above-described embodiments may also be described in the following appendix, but are not limited to the following.

Appendix 1

A substrate processing apparatus according to Appendix 1 is a substrate processing apparatus for processing a substrate, the substrate processing apparatus includes a swing module, the swing module includes a base portion, an arm which is supported by the base portion and is rotatable about the base portion, and a cover which covers an upper surface of the arm, the cover has an elongated shape in plan view and has a protrusion formed on an outer peripheral portion of an upper surface of the cover to protrude upward, and the protrusion is provided to be continuous to a distal end which is an end on the side farther from the base portion of the upper surface of the cover in a longitudinal direction and both ends of the upper surface of the cover in a transverse direction.

In the substrate processing apparatus according to Appendix 1, the cover of the swing module has the protrusion provided to be continuous to the distal end and both ends of the upper surface of the cover in the transverse direction. Therefore, the protrusion suppresses the liquid moving to the distal end due to the rotation of the arm from falling downward from the outside of the distal end. That is, the substrate processing apparatus can suppress the liquid remaining on the upper surface of the cover from falling downward from the distal end of the cover when the arm of the swing module swings.

Appendix 2

The substrate processing apparatus according to Appendix 2 is the substrate processing apparatus according to Appendix 1, the substrate processing apparatus includes a polishing device for polishing the substrate using a polishing liquid, the polishing device includes a polishing table which supports a polishing pad having a polishing surface, and the arm is a dresser arm which supports a dresser for dressing the polishing surface of the polishing pad.

The substrate processing apparatus according to Appendix 2 can suppress the dilution of the polishing liquid. Further, the substrate processing apparatus according to Appendix 2 can suppress the substrate from being scratched.

Appendix 3

The substrate processing apparatus according to Appendix 3 is the substrate processing apparatus according to Appendix 1 or 2, the upper surface of the cover has an inclined surface inclined downward and toward the base portion, and the inclined surface extends continuously in the longitudinal direction of the cover from the distal end to a proximal end which is an end on the side near the base portion in the longitudinal direction without being horizontal.

The substrate processing apparatus according to Appendix 3 can reduce the liquid remaining on the upper surface of the cover and drain the liquid adhering to the upper surface of the cover at a position on the side of the base portion.

Appendix 4

The substrate processing apparatus according to Appendix 4 is the substrate processing apparatus according to Appendix 3 and the inclined surface has an inclination of 10° or more with respect to a horizontal plane.

Appendix 5

The substrate processing apparatus according to Appendix 5 is the substrate processing apparatus according to Appendix 2 and the protrusion is provided on an entire portion that passes directly above the polishing table due to rotation of the arm in the outer peripheral portion of the upper surface of the cover.

In the substrate processing apparatus according to Appendix 5, since the protrusion is provided on the entire portion that passes directly above the polishing table in the outer peripheral portion, the liquid is less likely to fall onto the polishing table. That is, the substrate processing apparatus can suppress the liquid on the upper surface of the cover from falling onto the polishing table.

Appendix 6

The substrate processing apparatus according to Appendix 6 is the substrate processing apparatus according to Appendix 1 or 2 and the protrusion has a height of 3 mm or more.

Appendix 7

The substrate processing apparatus according to Appendix 7 is the substrate processing apparatus according to Appendix 1 or 2 and the protrusion has a width of 3 mm or less.

Appendix 8

The substrate processing apparatus according to Appendix 8 is the substrate processing apparatus according to Appendix 1 or 2 and a water-repellent layer or a hydrophilic layer is formed on a surface of the cover.

In the substrate processing apparatus according to Appendix 8, since the surface of the cover is water-repellent or hydrophilic, the liquid adhering to the surface of the cover quickly flows to be removed. Therefore, the substrate processing apparatus can suppress the liquid from remaining on the surface of the cover.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A substrate processing apparatus for processing a substrate, comprising:

a swing module, wherein the swing module includes a base portion, an arm which is supported by the base portion and is rotatable about the base portion, and a cover which covers an upper surface of the arm, wherein the cover has an elongated shape in plan view and has an upper surface, a side surface extending downward from an outer peripheral portion of the upper surface, a distal end which is an end on a side farther from the base portion of the upper surface in a longitudinal direction, and a first end and a second end of the upper surface in a transverse direction, the cover includes a protrusion formed on the outer peripheral portion of the upper surface of the cover to protrude upward, and wherein the protrusion is provided at the distal end, the first end and the second end of the cover to be continuous with the outer peripheral portion of the upper surface extending above the side surface of the cover.

2. The substrate processing apparatus according to claim 1, wherein the substrate processing apparatus includes a polishing device for polishing the substrate using a polishing liquid, wherein the polishing device includes a polishing table which supports a polishing pad having a polishing surface, and wherein the arm is a dresser arm which supports a dresser for dressing the polishing surface of the polishing pad.

3. The substrate processing apparatus according to claim 1, wherein the upper surface of the cover has an inclined surface inclined downward and toward the base portion, and wherein the inclined surface extends continuously in the longitudinal direction of the cover from the distal end to a proximal end which is an end on a side near the base portion in the longitudinal direction without being horizontal.

4. The substrate processing apparatus according to claim 3, wherein the inclined surface has an inclination of 10° or more with respect to a horizontal plane.

5. The substrate processing apparatus according to claim 2, wherein the protrusion is provided on an entire portion that passes directly above the polishing table due to rotation of the arm in the outer peripheral portion of the upper surface of the cover.

6. The substrate processing apparatus according to claim 1, wherein the protrusion has a height of 3 mm or more.

7. The substrate processing apparatus according to claim 1, wherein the protrusion has a width of 3 mm or less.

8. The substrate processing apparatus according to claim 1, wherein a water-repellent layer or a hydrophilic layer is formed on a surface of the cover.

* * * * *